US009920760B2

(12) United States Patent
Sung et al.

(10) Patent No.: US 9,920,760 B2
(45) Date of Patent: Mar. 20, 2018

(54) SCROLL COMPRESSOR

(71) Applicant: LG ELECTRONICS INC., Seoul (KR)

(72) Inventors: Sanghun Sung, Seoul (KR); Kangwook Lee, Seoul (KR); Yongkyu Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 447 days.

(21) Appl. No.: 14/286,903

(22) Filed: May 23, 2014

(65) Prior Publication Data

US 2015/0337838 A1 Nov. 26, 2015

(51) Int. Cl.

| | |
|---|---|
| ***F04C 29/00*** | (2006.01) |
| ***F04C 18/00*** | (2006.01) |
| ***F04C 18/02*** | (2006.01) |
| ***F01C 17/06*** | (2006.01) |
| ***F04C 23/00*** | (2006.01) |

(52) U.S. Cl.

CPC ..... *F04C 18/0269* (2013.01); *F01C 17/066* (2013.01); *F04C 18/0215* (2013.01); *F04C 23/008* (2013.01)

(58) Field of Classification Search

CPC ..... F04C 18/0223; F04C 29/0042
USPC ..... 418/55.2
See application file for complete search history.

(56) References Cited

U.S. PATENT DOCUMENTS

2013/0089449 A1* 4/2013 Seong ..... F04C 23/001 418/55.2

FOREIGN PATENT DOCUMENTS

| | | |
|---|---|---|
| CN | 103047136 | 4/2013 |
| EP | 0 907 024 | 4/1999 |
| EP | 2 581 605 | 4/2013 |
| JP | 10-213082 | 8/1998 |

OTHER PUBLICATIONS

Chinese Office Action dated Jan. 26, 2016.
European Search Report dated Apr. 9, 2015.

* cited by examiner

*Primary Examiner* — Mark Laurenzi
*Assistant Examiner* — Anthony Ayala Delgado
(74) *Attorney, Agent, or Firm* — KED & Associates LLP

(57) ABSTRACT

A scroll compressor is provided. An interference prevention portion may be formed on a side wall surface of at least one of a fixed wrap or an orbiting wrap. With such a configuration, an end of the fixed wrap may not interfere with the orbiting wrap at an arc compression surface of the orbiting wrap, but rather, be inserted into the interference prevention portion. Accordingly, occurrence of a gap between the fixed wrap and the orbiting wrap may be prevented, and thus, compression efficiency enhanced.

18 Claims, 11 Drawing Sheets

SCROLL COMPRESSOR

CROSS-REFERENCE TO RELATED APPLICATION(S)

Pursuant to 35 U.S.C. §119(a), this application claims priority to Korean Application No. 10-2013-0059180, filed in Korea on May 24, 2013, the contents of which are hereby incorporated by reference herein in their entirety.

BACKGROUND

1. Field

A scroll compressor is disclosed herein.

2. Background

Generally, a scroll compressor is a compressor configured to suck and compress a refrigerant using a structure including an orbiting scroll that performs an orbital motion with respect to a fixed scroll, in a state in which a fixed wrap of the fixed scroll is engaged with an orbiting wrap of the orbiting scroll. In this case, a compression chamber including a suction chamber, an intermediate pressure chamber, and a discharge chamber is consecutively moved between the fixed wrap and the orbiting wrap.

Such a scroll compressor is more advantageous than other types of compressors with respect to vibration and noise, as it performs a suction process, a compression process, and a discharge process consecutively. Behavior characteristics of the scroll compressor may be determined by a type of the fixed wrap and the orbiting wrap. The fixed wrap and the orbiting wrap may have any shape. However, generally, the fixed wrap and the orbiting wrap have the form of an involute curve which can be easily processed. The involute curve has a path formed by the end of a string when the string wound on a basic circle having an arbitrary radius is unwound. In the case of using such an involute curve, a capacity change rate is constant because a thickness of the wrap is constant. For a high compression ratio, a number of turns of the wrap should be increased. However, in this case, a size of the scroll compressor may be also increased.

In the orbiting scroll, an orbiting wrap may be formed at a surface of a plate formed in a disc shape. A boss portion may be formed on a surface of the plate on which the orbiting wrap has not been formed, to be connected to a rotational shaft that drives the orbiting scroll to perform an orbital motion. Such structure is advantageous in that a diameter of the plate may be reduced, because the orbiting wrap is formed on an almost entire area of the plate. However, with such structure, a point of application at which a repulsive force of a refrigerant is applied during a compression operation, and a point of application at which a reaction force to attenuate the repulsive force is applied are spaced from each other in a vertical direction. This may cause unstable behavior of the orbiting scroll during the operation, resulting in severe vibration or noise.

In order to solve such problems, a scroll compressor shown in FIG. 1 has been proposed. The scroll compressor of FIG. 1 has a structure in which a coupling point between a rotational shaft 1 and an orbiting scroll 2 is formed on the same surface as an orbiting wrap 2*a*. In such a scroll compressor, as a point of application at which a repulsive force of a refrigerant is applied, and a point of application at which a reaction force to attenuate the repulsive force is applied are the same, a phenomenon in that the orbiting scroll 2 is tilted may be solved.

An Oldham ring 4, configured to prevent rotation of the orbiting scroll 2, is installed between the orbiting scroll 2 and a fixed scroll 3. The orbiting scroll 2 and the Oldham ring 4 perform a relative motion with respect to each other in a state in which key recesses 2*b* and keys 4*a* are coupled to each other. The Oldham ring 4 induces the orbiting scroll 2 to perform an orbital motion. The key recesses 2*b* of the orbiting scroll 2 and the keys 4*a* of the Oldham ring 4 are coupled to each other with a tolerance gap δ1 of about 10~30 μm, so that the orbiting scroll 2 may perform a sliding motion with respect to the Oldham ring 4.

However, the conventional scroll compressor may have the following problems. As shown in FIG. 2, due to the tolerance gap δ1 between the key recesses 2*b* of the orbiting scroll 2 and the keys 4*a* of the Oldham ring 4, a rotational moment occurs when the orbiting scroll 2 performs the orbital motion. Due to such rotational moment, offset is generated at a specific portion between the orbiting wrap 2*a* of the orbiting scroll 2 and the fixed wrap 3*a* of the fixed scroll, that is, at both sides of an arc compression surface based on contact points formed by a tangent line and the arc compression surface, the tangent line being drawn from a center of a rotational shaft coupling portion of the orbiting scroll 2 toward the arc compression surface. Due to the offset of the orbiting scroll 2 in such offset section β, interference A occurs between the orbiting wrap 2*a* and the fixed wrap 3*a*, as shown in FIG. 3. Due to such interference A, a leakage gap B between the orbiting wrap 2*a* and the fixed wrap 3*a* occurs at other portions. This may cause compression loss.

BRIEF DESCRIPTION OF THE DRAWINGS

Embodiments will be described in detail with reference to the following drawings in which like reference numerals refer to like elements, and wherein.

DETAILED DESCRIPTION

Figure 1:
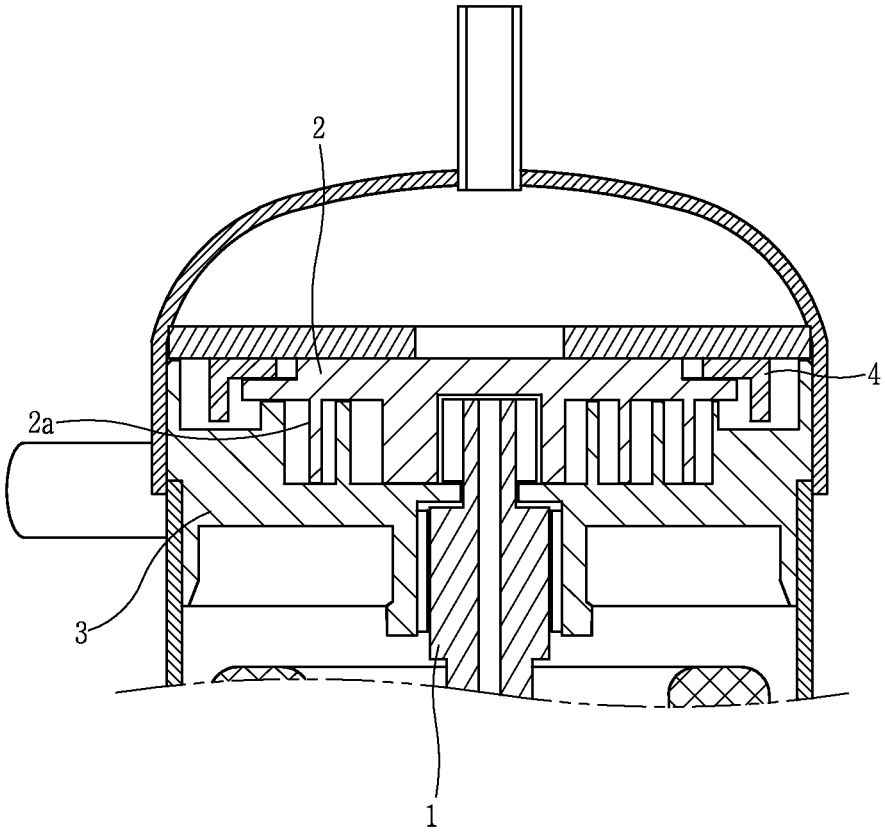
FIG. 1 is a partial longitudinal sectional view of a scroll compressor in accordance with the conventional art.
Figure 2:
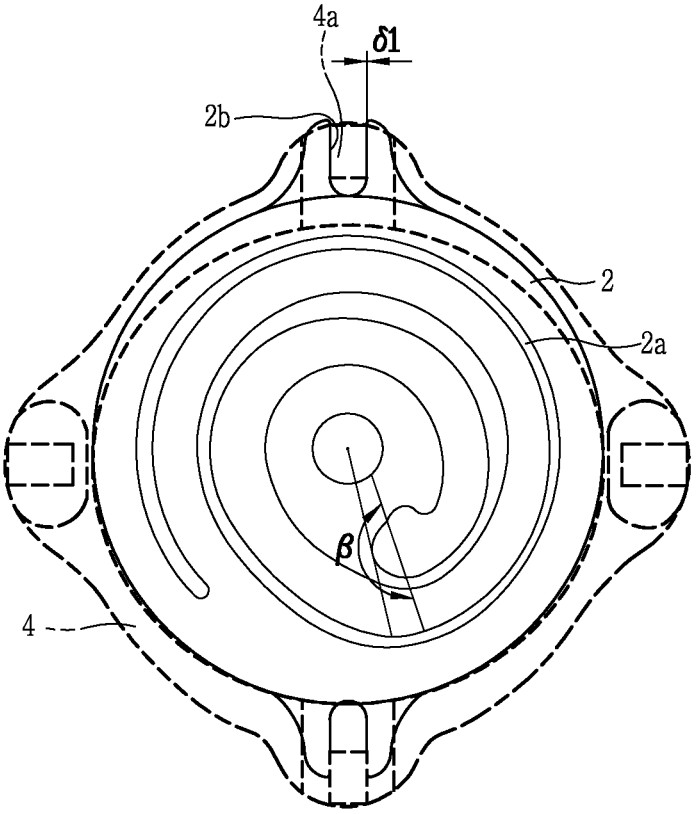
FIG. 2 is a schematic planar view illustrating a coupled state between an orbiting scroll and an Oldham ring in the scroll compressor of FIG. 1.

Description will now be given in detail of embodiments, with reference to the accompanying drawings. For the sake of brief description with reference to the drawings, the same or equivalent components will be provided with the same reference numbers, and description thereof will not be repeated.

Hereinafter, a scroll compressor according to embodiments will be explained in more detail with reference to the attached drawings.

Referring to FIGS. 4 to 9, in a scroll compressor according to embodiments, a drive motor 20 may be installed in a hermetic container 10, and a fixed scroll 30 integrally formed with a main frame may be fixedly installed above the drive motor 20. An orbiting scroll 40, which is engaged with the fixed scroll 30 and configured to compress a refrigerant while performing an orbiting motion by being coupled to a rotational shaft 23 of the drive motor 20, may be installed above the fixed scroll 30.

The hermetic container 10 may include a cylindrical casing 11, and an upper shell 12 and a lower shell 13 coupled to an upper portion and a lower portion of the casing 11 by, for example, welding so as to cover the upper portion and the lower portion of the casing 11. A suction pipe 14 may be installed on a side surface of the casing 10, and a discharge pipe 15 may be installed above the upper shell 12. The lower shell 13 may also serve as an oil chamber to store therein oil to be supplied to compressor components for a smooth operation of the compressor.

The drive motor 20 may include a stator 21 fixed to an inner surface of the casing 10, and a rotor 22 positioned in the stator 21 and rotated by a reciprocal operation with the stator 21. The rotational shaft 23, which rotates together with the rotor 22, may be coupled to a central portion of the rotor 22.

An oil passage F may be penetratingly-formed at a central region of the rotational shaft 23, in a lengthwise direction. An oil pump (not shown), configured to supply oil stored in the lower shell 13 to the upper side, may be installed at a lower end of the rotational shaft 23. A pin portion 23*c* may be formed at an upper end of the rotational shaft 23, in an eccentric manner from a center of the rotational shaft 23.

The fixed scroll 30 may be fixed, that is, an outer circumferential surface of the fixed scroll 30 may be forcibly-inserted between the casing 11 and the upper shell 12 by, for example, shrinkage fitting. Alternatively, the fixed scroll 30 may be coupled to the casing 11 and the upper shell 12 by, for example, welding.

A boss portion 32 may be formed at a central region of a plate portion 31 of the fixed scroll 30. A shaft accommodating hole 33, configured to accommodate the rotational shaft 23 in a penetrating manner, may be formed at the boss portion 32. A fixed wrap 34 may be formed on an upper surface of the plate portion 31 of the fixed scroll 30. The fixed wrap 34 is engaged with an orbiting wrap 42 to be explained hereinbelow, and forms a first compression chamber S1 on an outer side surface of the orbiting wrap 42 and a second compression chamber S2 on an inner side surface of the orbiting wrap 42.

The orbiting scroll 40 may be supported at a first or upper surface of the fixed scroll 30. The orbiting scroll 40 may include the plate portion 41 formed in an approximately circle shape, and the orbiting wrap 42 formed on a first or upper surface of the plate portion 41. The orbiting wrap 42 may form the compression chambers S1 and S2 which move consecutively, by being engaged with the fixed wrap 34. Each of the compression chambers S1 and S2 may include of a suction chamber, an intermediate pressure chamber, and a discharge chamber. A rotational shaft coupling portion 43, which may have an approximately circle shape and to which the pin portion 23*c* of the rotational shaft 23 may be rotatably insertion-coupled, may be formed at a central region of the plate portion 41.

The pin portion 23*c* of the rotational shaft 23 may be insertion-coupled to the rotational shaft coupling portion 43. The pin portion 23*c* may be coupled to the rotational shaft coupling portion 43 of the orbiting scroll 30, through the plate portion 31 of the fixed scroll 30.

Figure 4:
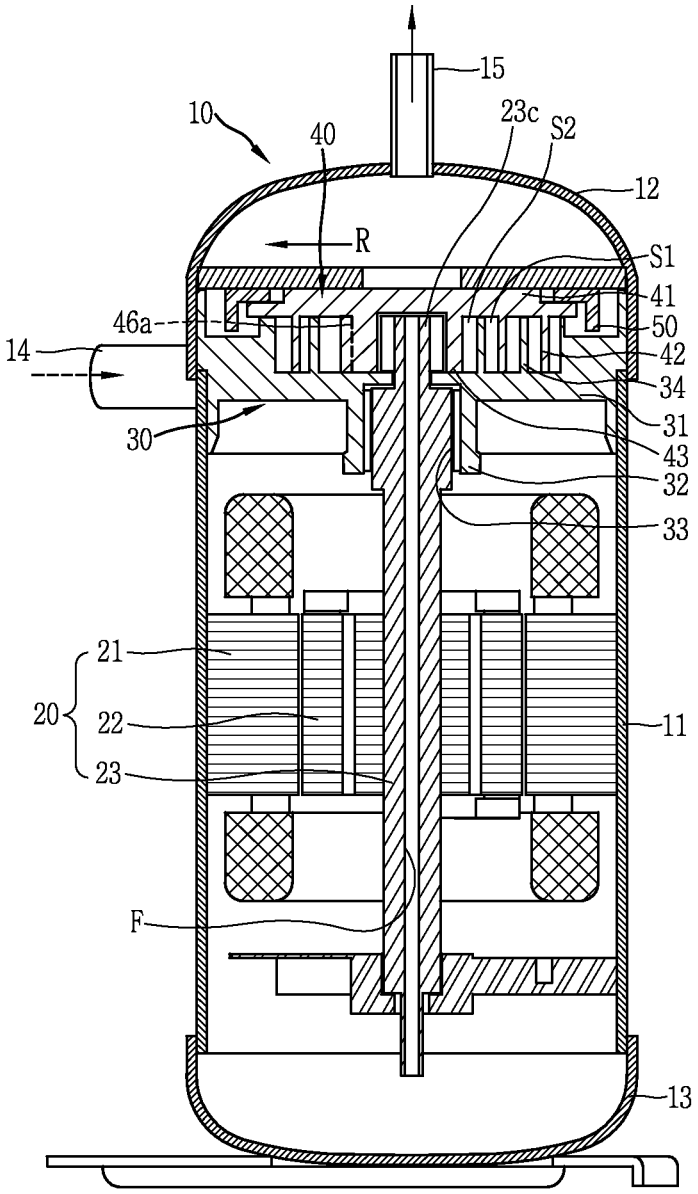
FIG. 4 is a longitudinal sectional view of a scroll compressor according to an embodiment.
Figure 5:
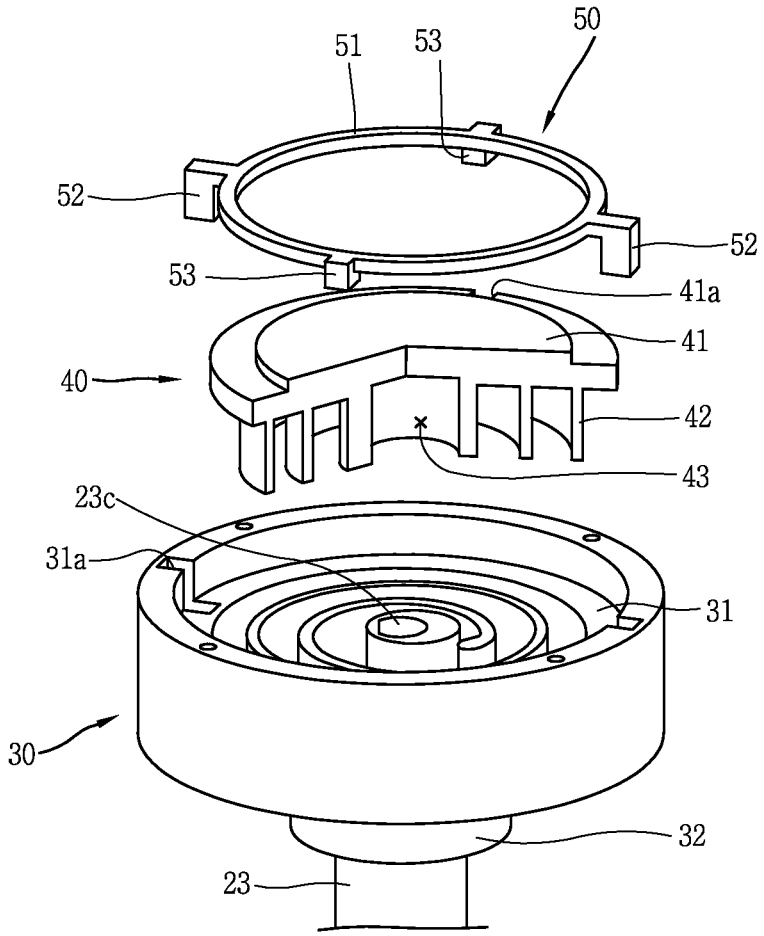
FIG. 5 is an exploded perspective view of a compression device in the scroll compressor of FIG. 4.

The orbiting wrap 42, the fixed wrap 34, and the pin portion 23*c* may be formed to overlap one another, in a radial direction (arrow R in FIG. 4) of the scroll compressor, as shown in FIG. 4. That is, when the orbiting wrap 42 is engaged with the fixed wrap 34, and the pin portion 23*c* of the rotational shaft 23 is insertion-coupled to the rotational shaft coupling portion 43, the orbiting wrap 42, the fixed wrap 34, and the pin portion 23*c* overlap or overlay each other with respect to the radial direction of the scroll compressor. During a compression operation of the scroll compressor, a repulsive force of a refrigerant may be applied to the fixed wrap 34 and the orbiting wrap 42. As a reaction force to the repulsive force, a compressive force may be applied between the rotational shaft coupling portion 43 and the pin portion 23*c*. In the case where the pin portion 23*c* of the rotational shaft 23 overlaps the wrap in a radial direction through the plate portion 41 of the orbiting scroll 40, the repulsive force of the refrigerant and the compressive force may be applied to the same side surface based on the plate portion 41 of the orbiting scroll 40. Therefore, the repulsive force and the compressive force may attenuate each other.

An Oldham ring 50, configured to prevent rotation of the orbiting scroll 40, may be coupled to a first or upper side of the orbiting scroll 40. The Oldham ring 50 may include a ring portion 51 having an approximately circle shape and fitted into a second or rear surface of the plate portion 41 of the orbiting scroll 40, and a pair of first keys 52 and a pair of second keys 53 that protrude from a side surface of the ring portion 51.

The pair of first keys 52 may protrude with a length greater than a thickness of an outer circumferential surface of the plate portion 41 of the orbiting scroll 40, and may be inserted into first key recesses 31*a* of the fixed scroll 30. The second keys 53 may be fitted into second key recesses 41*a* formed on an outer circumference of the plate portion 41 of the orbiting scroll 40.

Figure 6:
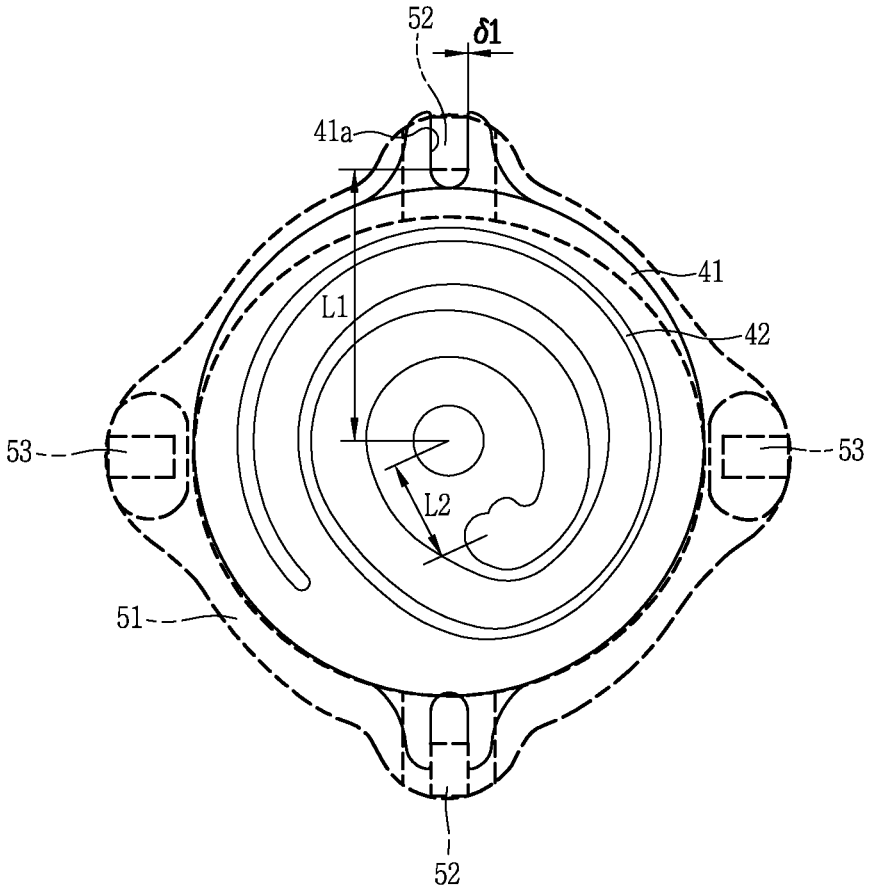
FIG. 6 is a schematic planar view illustrating a coupled state between an orbiting scroll and an Oldham ring in the scroll compressor of FIG. 5.

Each first key recess 31*a* and corresponding first key 52 may be formed so that both side surfaces of the first key 52 slidably-contact both side surfaces of the first key recess 31*a*. Likewise, each second key recess 41*a* and corresponding second key 53 may be formed so that both side surfaces of the second key 53 slidably-contact both side surfaces of the second key recess 41*a*. In this case, if the keys 52, 53 contact the key recesses 31*a*, 41*a* too closely, frictional resistance may be increased between the keys 52, 53 and the key recess 31*a*, 41*a*. As a result, the orbiting scroll 40 may not smoothly perform an orbital motion. In order to solve such problems, as shown in FIG. 6, a tolerance gap δ1 may be formed between the key recess 31*a* and the key 52, and between the key recess 41*a* and the key 53. In this case, the tolerance gap δ1 may be large enough for the orbiting scroll 40 to perform an orbital motion as the keys 52, 53 smoothly slide on or in the key recesses 31*a*, 41*a*.

Figure 7A:
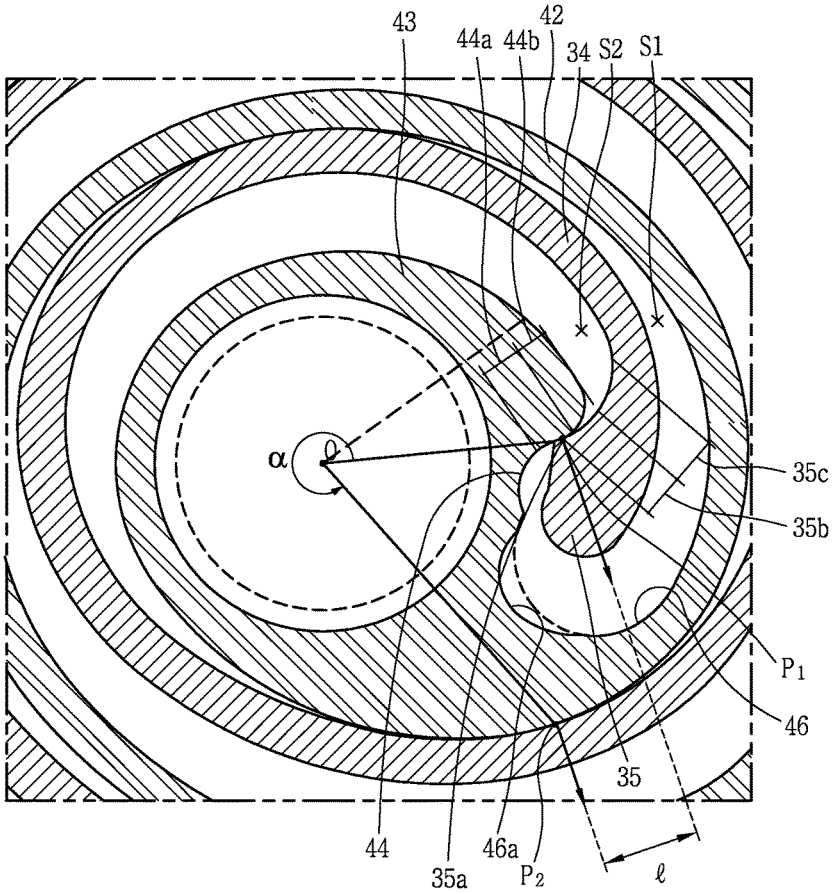
FIGS. 7A-7B are schematic planar views illustrating a compression device in the scroll compressor of FIG. 4.
Figure 7B:
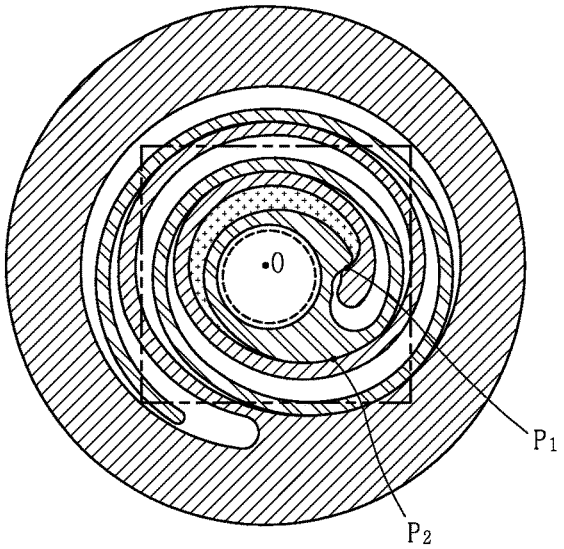
Figure 8:
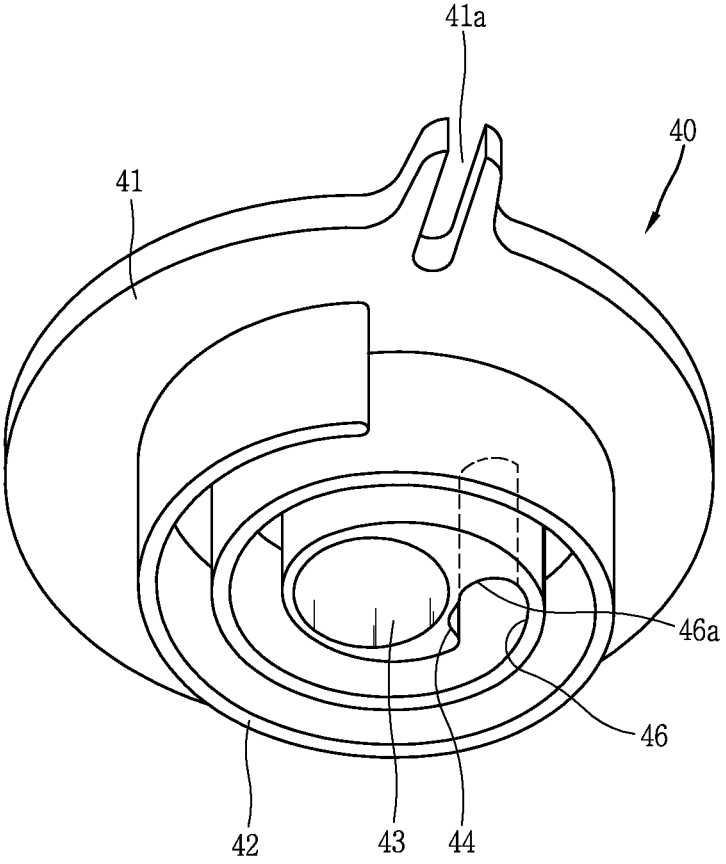
FIG. 8 is a perspective view of an orbiting scroll in the scroll compressor of FIG. 4.

Each of the fixed wrap 34 and the orbiting wrap 42 may be formed in an involute curve. However, in some cases, the fixed wrap 34 and the orbiting wrap 42 may be formed in another curve rather than an involute curve. Referring to FIGS. 7A-7B, under an assumption that a center of the rotational shaft coupling portion 43 is '0' and two contact points are $P_1$ and $P_2$, an angle α defined by two straight lines may be smaller than 360°, the straight lines being formed by connecting the center '0' of the rotational shaft coupling portion 43 to the two contact points $P_1$ and $P_2$, respectively. Also, a distance l between a normal vector of the contact point $P_1$ and a normal vector of the contact point $P_2$ may be larger than 0. With such a configuration, the scroll compressor may have an increased compression ratio, because it has a smaller volume than in a case in which the first compression chamber S1 prior to discharge is formed by the fixed wrap 34 and the orbiting wrap 42 each having an involute curve. The orbiting wrap 42 and the fixed wrap 34 have a shape where a plurality of arcs having different diameters and origins are connected. In this case, an outermost curve may have an approximately oval shape with a major axis and a minor axis.

A protruded portion 35, which protrudes toward the rotational shaft coupling portion 43, may be formed near an inner end portion of the fixed wrap 34. A contact portion 35*a* may be further formed at the protruded portion 35, in a protruding manner from the protruding portion 35. Accordingly, an inner end portion of the fixed wrap 34 may have a larger thickness than other portions of the fixed wrap 34.

The thickness of the fixed wrap 34 may be gradually decreased, starting from inner contact point P1 of the two contact points $P_1$, $P_2$ defining the first compression chamber S1 upon initiating the discharge operation. More specifically, a first decreasing portion 35*b* may be formed adjacent to the contact point P1 and a second decreasing portion 35*c* may be connected to the first decreasing portion 35*b*. A thickness reduction rate of the first decreasing portion 35*b* may be higher than a thickness reduction rate of the second decreasing portion 35*c*. After the second decreasing portion 35*c*, the fixed wrap 34 may be increased in thickness within a predetermined interval.

A recess portion 44, which may be engaged with the protruded portion 35, may be formed at the rotational shaft coupling portion 43. A side wall of the recess portion 44 may contact the contact portion 35*a* of the protruded portion 35, thereby forming the contact point $P_1$ of the first compression chamber S1.

The side wall of the recess portion 44 may include a first increasing portion 44*a* where a thickness is relatively greatly increased, and a second increasing portion 44*b* connected to the first increasing portion 44*a* and having a thickness increased at a relatively low rate. These correspond to the first decreasing portion 35*b* and the second decreasing portion 35*c* of the fixed wrap 34. The first increasing portion 44*a*, the first decreasing portion 35*b*, the second increasing portion 44*b* and the second decreasing portion 35*c* may be obtained by turning a generating curve toward the rotational shaft coupling portion. Accordingly, the inner contact point P1 of the first compression chamber S1 may be positioned at the first increasing portion 44*a* and the second increasing portion 44*b*, and the length of the first compression chamber right before a discharge operation may be shortened so as to enhance a compression ratio.

Another side wall of the recess portion 44 may be formed to have an arc compression surface 46 having a circular shape and formed by connecting lines to one another, the lines formed as the orbiting wrap 42 contacts the end of the fixed wrap 34 while the orbiting scroll 40 performs an orbital motion. A diameter of the arc of the arc compression surface 46 may be determined by a wrap thickness of the end of the fixed wrap 34, and an orbiting radius of the orbiting wrap 42. If the wrap thickness of the end of the fixed wrap 24 is increased, the diameter of the arc may be increased. As a result, the thickness of the orbiting wrap 42 near the arc may be increased, and thus, durability of the scroll compressor enhanced. Further, a compression path may be increased, and thus, a compression ratio of the second compression chamber S2 is increased.

An operation of the scroll compressor according to embodiments may be as follows. Once the rotational shaft 23 rotates as power is supplied to the drive motor 20, the orbiting scroll 40 eccentrically-coupled to the rotational shaft 23 may perform an orbital motion along a predetermined path. The compression chambers S1, S2 formed between the orbiting scroll 40 and the fixed scroll 30 may move to a center of the orbital motion consecutively, to thus have a decreased volume. In the compression chambers S1, S2, a refrigerant may be sucked, compressed, and discharged consecutively. Such processes may be repeatedly performed.

Figure 3:
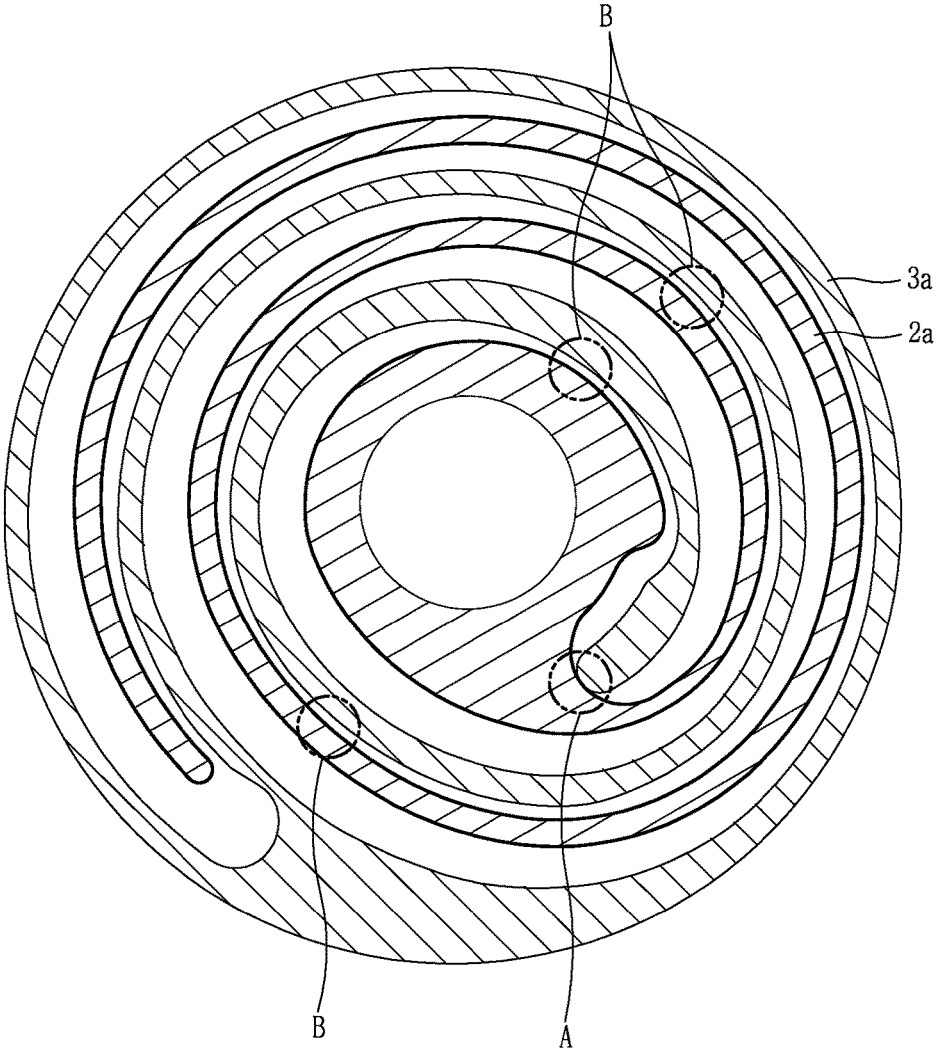
FIG. 3 is a schematic planar view illustrating a relationship between a fixed scroll and the orbiting scroll in the scroll compressor of FIG. 2.

The orbiting scroll 40 may perform an orbital motion while its rotation is prevented by the Oldham ring 50. A tolerance gap δ1 of approximately 10~30 μm is required between the key recess 41*a* of the orbiting scroll 40 and the key 52, and between the key recess 31*a* of the fixed scroll 30 and the key 53, so that the orbiting scroll 40 and the Oldham ring 50 may perform a sliding motion with respect to each other. In this case, the orbiting scroll 40 may generate a rotational moment due to the tolerance gap δ1. As a result, when the scroll compressor is operated, wrap interference A may occur between the fixed wrap 34 and the orbiting wrap 42, as shown in FIG. 3.

In this embodiment, as shown in FIGS. 6 to 9, an interference prevention portion 46*a* having a predetermined depth in a thickness direction of the orbiting wrap 42 may be formed at the arc compression surface 46 of the recess portion 44 of the orbiting scroll 40. The interference prevention portion 46*a* may be formed to have a depth 62 from an orbiting radius r which is obtained in a state in which the fixed wrap 34 and the orbiting wrap 42 have been aligned to be concentric with each other.

Figure 9:
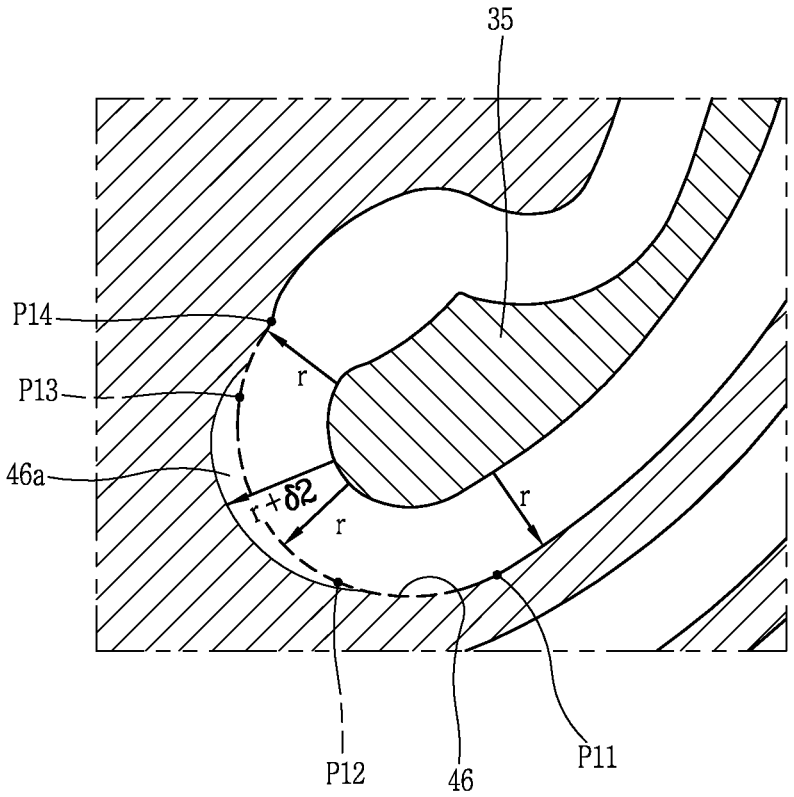
FIG. 9 is an enlarged schematic view for explaining an interference prevention portion of FIG. 8.

For instance, as shown in FIG. 9, a starting point of a second curved surface P12~P13 which forms the interference prevention portion 46*a* may be positioned at a first curved surface P11~P12 between a first point P11 where arc compression starts and an arbitrary second point P12. An ending point of the second curved surface P12~P13 which forms the interference prevention portion 46*a* may be positioned at a third curved surface P13~P14 between an arbitrary third point P13 closer to a discharge opening than the second point P12 and a fourth point P14 where compression is ended.

A depth of the interference prevention portion 46*a* may be equal to or smaller than tolerance gap δ1. If the depth of the interference prevention portion 46*a* is larger than the tolerance gap δ1, a gap may be generated between the fixed wrap 34 and the orbiting wrap 42. This may cause compression performance to be significantly lowered.

Referring to FIG. 6, assuming that a rotational angle (radian) of the rotational shaft 23 is α, a tolerance gap is δ1, a shortest distance between the second key recess 41*a* and a center or central longitudinal axis of the rotational shaft coupling portion 43 is L1, a shortest distance between a center or central longitudinal axis of the orbiting wrap 42 and the center of the rotational shaft coupling portion 43 is L2, a depth (offset amount) of the interference prevention portion 46*a* is δ2. Under such assumptions, δ2 may be calculated as follows.

$$\alpha \times L1 = \delta 1 \qquad \text{Formula 1.}$$

$$\alpha \times L2 = \delta 2 \qquad \text{Formula 2.}$$

When Formula 1 is applied to Formula 2, $\delta 2=\delta 1\times(L2/L1)$. For instance, $\delta 2=30\times 23/53=13.0$ μm, in a case in which the tolerance gap δ1 is 30 μm, the shortest distance L1 between the second key recess 41*a* and a center of the rotational shaft coupling portion 43 is 53 mm, and the shortest distance L2 between a center line of the orbiting wrap 42 and the center of the rotational shaft coupling portion 46*a* is 23 mm. Accordingly, an equation of $\delta 2=(\delta 1\times(L2/L1))\pm 5$ μm may be obtained.

Figure 10:
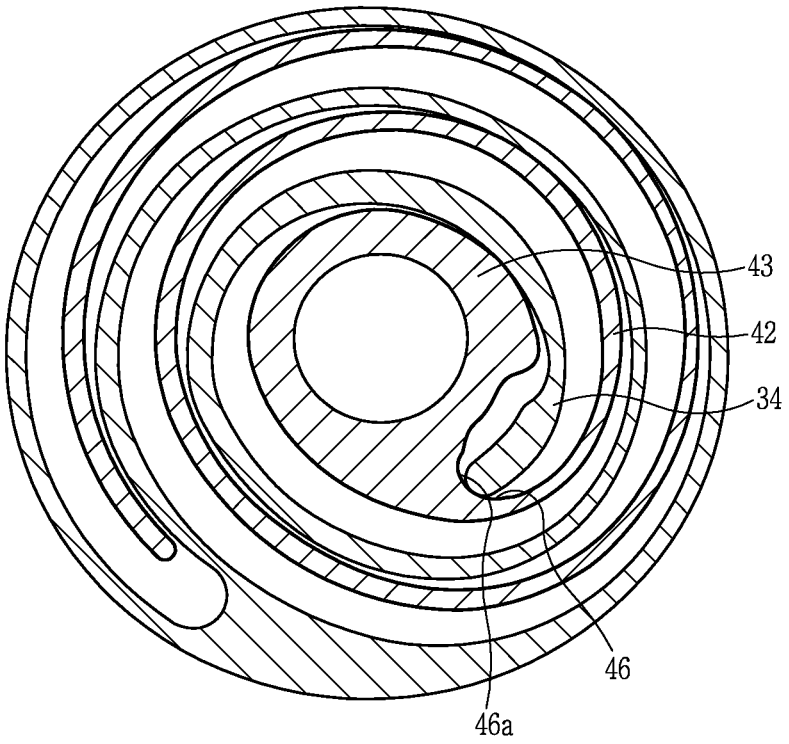
FIG. 10 is a schematic planar view illustrating a relationship between a fixed scroll and an orbiting scroll in the scroll compressor of FIG. 4.

As shown in FIG. 10, the end of the fixed wrap 34 does not interference with the orbiting wrap 42 at the arc compression surface 46 of the orbiting wrap 42, but is inserted into the interference prevention portion 46*a*. Accordingly, occurrence of a gap between the fixed wrap 34 and the orbiting wrap 42 may be prevented, and thus, compression efficiency may be enhanced.

Figure 11:
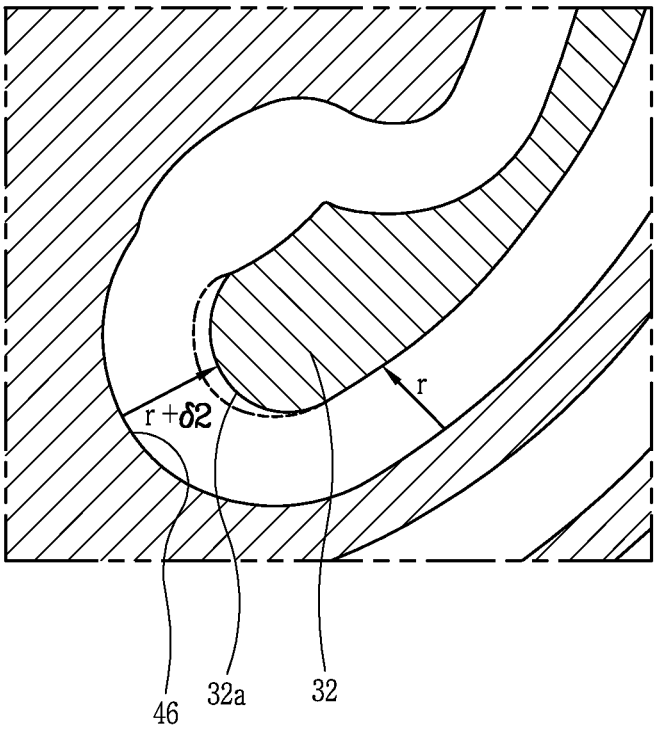
FIG. 11 is a schematic planar view illustrating another embodiment of an interference prevention portion in the scroll compressor of FIG. 4.

In the aforementioned embodiment, the interference prevention portion 46*a* is formed at the arc compression surface 46 of the orbiting scroll 42. However, in the embodiment of FIG. 11, the interference prevention portion 46*a* may be formed at a starting end of the fixed wrap 34 of the fixed scroll 30, the fixed wrap which corresponds to the arc compression surface 46 of the orbiting scroll 40. In this case, an interference prevention portion 32*a* may be formed to have a predetermined depth in a thickness direction of the fixed wrap 34, on an outer circumferential surface of the fixed wrap 34 which contacts the arc compression surface 46, within a section where arc compression is performed based on the orbiting scroll 40.

Like in the aforementioned embodiment, the depth of the interference prevention portion 32*a* may be equal to or smaller than the tolerance gap (δ1) formed between the key recess 41*a* of the orbiting scroll 40 and the key 53 of the Oldham ring 50. The effects of this embodiment are almost the same as those of the aforementioned embodiment, and thus, detailed explanations thereof have been omitted.

Embodiments disclosed herein provide a scroll compressor capable of preventing occurrence of a leakage gap between an orbiting wrap of an orbiting scroll and a fixed wrap of a fixed scroll, by preventing interference between the orbiting wrap and the fixed wrap.

Embodiments disclosed herein provide a scroll compressor that may include a hermetic container; a fixed scroll having a fixed wrap; an orbiting scroll having an orbiting wrap which forms a compression chamber by being engaged with the fixed wrap, having a rotational shaft coupling portion at a center portion thereof, having an arc compression surface which forms the compression chamber around the rotational shaft coupling portion, and performing an orbital motion with respect to the fixed scroll; and a rotational shaft having an eccentric portion which is coupled to the orbiting scroll, the eccentric portion overlapped with the orbiting wrap in a radial direction, wherein an interference prevention portion may be formed at the fixed wrap or the orbiting wrap such that an interval between the fixed wrap and the orbiting wrap is larger than an orbiting radius of the orbiting wrap. The interference prevention portion may be formed at the arc compression surface. The interference prevention portion may be formed such that a starting point and an ending point thereof are included in the arc compression surface.

The scroll compressor may further include an Oldham ring coupled to the orbiting scroll and configured to prevent rotation of the orbiting scroll. A tolerance gap may be formed between the orbiting scroll and the Oldham ring, and a maximum depth of the interference prevention portion may be equal to or smaller than the tolerance gap.

A plurality of key recesses may be formed at the orbiting scroll in a radial direction, such that keys of the Oldham ring may be coupled thereto. An equation of $\delta 2=(\delta 1\times(L2/L1))\pm 5$ μm may be obtained, where L1 is a shortest distance between the key recess and a center of the rotational shaft coupling portion, L2 is a shortest distance between a center line between the orbiting wraps and the center of the rotational shaft coupling portion, δ1 is a tolerance gap between the Oldham ring and the key recess, δ2 is a depth (offset amount) of the interference prevention portion, and a is an rotational angle of the rotational shaft. The rotational shaft may be coupled to the rotational shaft coupling portion of the orbiting scroll by passing through the fixed scroll.

Embodiments disclosed herein may further provide a scroll compressor that may include a fixed scroll having a fixed wrap; an orbiting scroll having an orbiting wrap which forms a first compression chamber and a second compression chamber on an outer side surface and an inner side surface thereof by being engaged with the fixed wrap, having a rotational shaft coupling portion at a center portion thereof, having an arc compression surface which forms the first compression chamber around the rotational shaft coupling portion, and performing an orbital motion with respect to the fixed scroll; and a rotational shaft having an eccentric portion which is coupled to the rotational shaft coupling portion of the orbiting scroll, the eccentric portion overlapped with the orbiting wrap in a radial direction. The arc compression surface may be spaced from a side wall surface of the fixed wrap by an orbiting radius, and a distance between the fixed wrap and the orbiting wrap may be equal to the orbiting radius at a first curved surface of the arc compression surface from a first point where the arc compression surface starts to an arbitrary second point, the distance being longer than the orbiting radius at a second curved surface of the arc compression surface from the second point to a third point where arc compression is performed, and the distance may be equal to the orbiting radius at a third curved surface of the arc compression surface from the third point to a fourth point where the arc compression is ended. A curvature of the second curved surface may be larger than a curvature of the first curved surface or the third curved surface.

The scroll compressor may further include an Oldham ring coupled to the orbiting scroll and configured to prevent rotation of the orbiting scroll. A tolerance gap may be formed between the orbiting scroll and the Oldham ring, and a maximum depth of the second curved surface may be equal to or smaller than the tolerance gap.

A plurality of key recesses may be formed at the orbiting scroll in a radial direction, such that keys of the Oldham ring are coupled thereto. An equation of $\delta 2=(\delta 1\times(L2/L1))\pm 5$ μm may be obtained, where L1 is a shortest distance between the key recess and a center of the rotational shaft coupling portion, L2 is a shortest distance between a center line of the orbiting wraps and the center of the rotational shaft coupling portion, δ1 is a tolerance gap between the Oldham ring and the key recess, δ2 is a depth (offset amount) of the second curved surface, and a is an rotational angle of the rotational shaft. The rotational shaft may be coupled to the rotational shaft coupling portion of the orbiting scroll by passing through the fixed scroll.

Embodiments disclosed herein further provide a scroll compressor that may include a fixed scroll having a fixed wrap; an orbiting scroll having an orbiting wrap which forms a first compression chamber and a second compression chamber on its outer side surface and inner side surface by being engaged with the fixed wrap, and performing an orbital motion with respect to the fixed scroll; a rotational shaft having an eccentric portion overlapped with the orbiting wrap in a radial direction; and a driving unit or drive configured to drive the rotational shaft. A rotational shaft coupling portion, to which the eccentric portion may be coupled, may be formed in a central portion of the orbiting scroll, a protruded portion may be formed on an inner circumferential surface of an inner end portion of the fixed wrap, a recess portion, which forms a compression chamber by contacting the protruded portion, may be formed on an outer circumferential surface of the rotational shaft coupling portion, and an interference prevention portion may be formed at the fixed wrap or the orbiting wrap such that an interval between the fixed wrap and the orbiting wrap is larger than an orbiting radius of the orbiting wrap. The interference prevention portion may be formed at the arc compression surface. The interference prevention portion may be formed such that a starting point and an ending point thereof are included in the arc compression surface.

The scroll compressor may further include an Oldham ring coupled to the orbiting scroll and configured to prevent rotation of the orbiting scroll. A tolerance gap may be formed between the orbiting scroll and the Oldham ring, and a maximum depth of the interference prevention portion may be equal to or smaller than the tolerance gap.

A plurality of key recesses may be formed at the orbiting scroll in a radial direction, such that keys of the Oldham ring may be coupled thereto. An equation of $\delta 2=(\delta 1\times(L2/L1))\pm 5$ μm may be obtained, where L1 is a shortest distance between the key recess and a center of the rotational shaft coupling portion, L2 is a shortest distance between a center of the orbiting wrap and the center of the rotational shaft coupling portion, δ1 is a tolerance gap between the Oldham ring and the key recess, δ2 is a depth (offset amount) of the second curved surface, and a is an rotational angle of the rotational shaft.

A thickness of the rotational shaft coupling portion may be increased within a predetermined section, toward an opposite direction to a moving direction of the compression chamber at the recess portion. A thickness of the fixed wrap may be decreased within a predetermined section, toward an opposite direction to a moving direction of the compression chamber at the protruded portion.

In the scroll compressor according to embodiments, the interference prevention portion may be formed on a side wall surface of at least one of a fixed wrap or an orbiting wrap. With such a configuration, the end of the fixed wrap does not interfere with the orbiting wrap at an arc compression surface of the orbiting wrap, but is inserted into the interference prevention portion. Accordingly, occurrence of a gap between the fixed wrap and the orbiting wrap may be prevented, and thus, compression efficiency enhanced.

Further scope of applicability of embodiments will become more apparent from the detailed description. However, it should be understood that the detailed description and specific examples, while indicating embodiments of the disclosure, are given by way of illustration only, since various changes and modifications within the spirit and scope of the disclosure will become apparent to those skilled in the art from the detailed description.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a hermetic container;

a fixed scroll having a fixed wrap;

an orbiting scroll having an orbiting wrap that forms a compression chamber by being engaged with the fixed wrap, the orbiting wrap having a rotational shaft coupling portion at a center portion thereof, the orbiting scroll having an arc compression surface, which forms a portion of the compression chamber adjacent the rotational shaft coupling portion, the orbiting scroll for performing an orbital motion with respect to the fixed scroll; and a rotational shaft having an eccentric portion coupled to the rotational shaft coupling portion of the orbiting scroll, the eccentric portion being overlapped with the orbiting wrap in a radial direction of the scroll compressor, wherein an arc compression surface is formed adjacent to the rotational shaft coupling portion of the orbiting wrap, wherein an interference prevention void, when a center of the fixed scroll matches a center of the orbiting scroll, is formed at the arc compression surface such that an interval between the fixed wrap and the orbiting wrap is larger than an orbiting radius of the orbiting wrap at the interference prevention void while the fixed wrap and the orbiting wrap are spaced from each other by the orbiting radius at portions except the interference prevention void.

2. The scroll compressor of claim 1, wherein the interference prevention void is formed such that a starting point and an ending point thereof are included in the arc compression surface.

3. The scroll compressor of claim 1, including an Oldham ring coupled to the orbiting scroll and configured to prevent rotation of the orbiting scroll, wherein a tolerance gap is formed between the orbiting scroll and the Oldham ring, and wherein a maximum depth of the interference prevention void is equal to the tolerance gap.

4. The scroll compressor of claim 3, wherein the Oldham ring includes a plurality of keys configured to be coupled to a plurality of key recesses formed at the orbiting scroll in the radial direction of the scroll compressor, and wherein the tolerance gap is formed between the plurality of keys of the Oldham ring and the plurality of key recesses of the orbiting scroll.

5. The scroll compressor of claim 4, wherein $\delta 2=(\delta 1\times(L2/L1))\pm 5$ μm, where L1 is a shortest distance between a key recess of the plurality of key recesses and a center of the rotational shaft coupling portion, L2 is a shortest distance between a center of the orbiting wrap and the center of the rotational shaft coupling portion, δ1 is the tolerance gap between the plurality of keys of the Oldham ring and the plurality of key recesses of the orbiting scroll, and δ2 is a depth (offset amount) of the interference prevention void.

6. The scroll compressor of claim 1, wherein the rotational shaft is coupled to the rotational shaft coupling portion of the orbiting scroll by passing through the fixed scroll.

7. A scroll compressor, comprising:

a fixed scroll having a fixed wrap, the fixed scroll having a protruded portion on an inner circumferential surface of an inner end portion;

an orbiting scroll having an orbiting wrap that forms a first compression chamber and a second compression chamber on an outer side surface and an inner side surface thereof, respectively, by being engaged with the fixed wrap, the orbiting wrap having a rotational shaft coupling portion at a center portion thereof, the orbiting scroll having a recess portion, which contacts the protruded portion, on an outer circumferential surface of the rotational shaft coupling portion, the orbiting scroll having an arc compression surface, which forms a portion of the first compression chamber adjacent the recess portion, the orbiting scroll for performing an orbital motion with respect to the fixed scroll; and a rotational shaft having an eccentric portion coupled to the rotational shaft coupling portion of the orbiting scroll, the eccentric portion being overlapped with the orbiting wrap in a radial direction of the scroll compressor, wherein the arc compression surface is spaced from a side wall surface of the fixed wrap by an orbiting radius of the orbiting scroll when a center of the fixed scroll matches a center of the orbiting scroll, wherein a distance between the fixed wrap and the orbiting wrap is equal to the orbiting radius at a first curved surface of the arc compression surface from a first point where the arc compression surface starts to an arbitrary second point, wherein the distance between the fixed wrap and the orbiting wrap is larger than the orbiting radius at a second curved surface of the arc compression surface from the second point to a third point so as to prevent the interference between the fixed wrap and the orbiting wrap, and wherein the distance between the fixed wrap and the orbiting wrap is equal to the orbiting radius at a third curved surface of the arc compression surface from the third point to a fourth point where the arc compression surface ends.

8. The scroll compressor of claim 7, wherein a curvature of the second curved surface is larger than a curvature of the first curved surface or the third curved surface, and wherein the curvature of the second curved surface is formed as a single curvature.

9. The scroll compressor of claim 7, including an Oldham ring coupled to the orbiting scroll and configured to prevent rotation of the orbiting scroll, wherein a tolerance gap is formed between the orbiting scroll and the Oldham ring, and wherein a maximum depth of the second curved surface is equal to the tolerance gap.

10. The scroll compressor of claim 9, wherein the Oldham ring includes a plurality of keys configured to be coupled to a plurality of key recesses formed at the orbiting scroll in the radial direction of the scroll compressor, and wherein the tolerance gap is formed between the plurality of keys of the Oldham ring and the plurality of key recesses of the orbiting scroll.

11. The scroll compressor of claim 10, wherein $\delta 2=(\delta 1\times(L2/L1))\pm 5$ μm, where L1 is a shortest distance between a key recess of the plurality of key recesses and a center of the rotational shaft coupling portion, L2 is a shortest distance between a center of the orbiting wrap and the center of the rotational shaft coupling portion, δ1 is the tolerance gap between the plurality of keys of the Oldham ring and the plurality of key recesses of the orbiting scroll, and δ2 is a depth of the second curved surface.

12. The scroll compressor of claim 7, wherein the rotational shaft is coupled to the rotational shaft coupling portion of the orbiting scroll by passing through the fixed scroll.

13. A scroll compressor, comprising:

a fixed scroll having a fixed wrap;

an orbiting scroll having an orbiting wrap that forms a first compression chamber and a second compression chamber on an outer side surface and an inner side surface thereof, respectively, by being engaged with the fixed wrap, the orbiting scroll for performing an orbital motion with respect to the fixed scroll;

a rotational shaft having an eccentric portion overlapped with the orbiting wrap in a radial direction of the scroll compressor; and a drive configured to drive the rotational shaft, wherein a rotational shaft coupling portion, to which the eccentric portion is coupled, is formed in a central portion of the orbiting scroll, wherein a protruded portion is formed on an inner circumferential surface of an inner end portion of the fixed wrap, wherein a recess portion, which contacts the protruded portion, is formed on an outer circumferential surface of the rotational shaft coupling portion, wherein an arc compression surface is formed at one side of the recess portion of the orbiting wrap, and wherein an interference prevention void, when a center of the fixed scroll matches a center of the orbiting scroll, is formed at the arc compression surface of the orbiting wrap such that an interval between the fixed wrap and the orbiting wrap is larger than an orbiting radius of the orbiting wrap at the interference prevention void while the fixed wrap and the orbiting wrap are spaced from each other by the orbiting radius at portions except the interference prevention void.

14. The scroll compressor of claim 13, wherein the interference prevention void is formed such that a starting point and an ending point thereof are included in the arc compression surface.

15. The scroll compressor of claim 13, including an Oldham ring coupled to the orbiting scroll and configured to prevent rotation of the orbiting scroll, wherein a tolerance gap is formed between the orbiting scroll and the Oldham ring, and wherein a maximum depth of the interference prevention void is equal to the tolerance gap.

16. The scroll compressor of claim 15, wherein the Oldham ring includes a plurality of keys configured to be coupled to a plurality of key recesses formed at the orbiting scroll in the radial direction of the scroll compressor, and wherein the tolerance gap is formed between the plurality of keys of the Oldham ring and the plurality of key recesses of the orbiting scroll.

17. The scroll compressor of claim 16, wherein $\delta 2=(\delta 1\times(L2/L1))\pm 5\ \mu m$, where L1 is a shortest distance between a key recess of the plurality of key recesses of the Oldham ring and a center of the rotational shaft coupling portion, L2 is a shortest distance between a center of the orbiting wrap and the center of the rotational shaft coupling portion, $\delta 1$ is the tolerance gap between the plurality of keys of the Oldham ring and the plurality of key recesses of the orbiting scroll, and $\delta 2$ is a depth of the interference prevention void.

18. The scroll compressor of claim 13, wherein a thickness of the rotational shaft coupling portion disposed adjacent the protruded portion is increased within a predetermined section, and wherein a thickness of the fixed wrap adjacent the protruded portion is decreased within a predetermined section.

* * * * *